United States Patent [19]

Moore et al.

[11] Patent Number: 4,651,918

[45] Date of Patent: Mar. 24, 1987

[54] DIVIDED CELL CONTAINER CONSTRUCTION

[75] Inventors: Carlton R. Moore, Statesville; Roger M. Wozniacki, Charlotte, both of N.C.

[73] Assignee: International Paper Co., New York, N.Y.

[21] Appl. No.: 783,602

[22] Filed: Oct. 3, 1985

[51] Int. Cl.[4] ..... B65D 5/42

[52] U.S. Cl. ..... 229/27; 229/28 R; 229/135

[58] Field of Search ..... 229/15, 27, 28 R, 28 BC, 229/135

[56] References Cited

U.S. PATENT DOCUMENTS

| | | | |
|---|---|---|---|
| 1,898,231 | 0/1933 | Weiss . | |
| 2,983,421 | 0/1961 | Turpin | 229/17 |
| 3,048,321 | 8/1962 | Sanford | 229/27 |
| 3,166,229 | 0/1965 | Sherman et al. | 229/27 |
| 3,228,581 | 1/1966 | Stegner | 229/27 |
| 3,326,444 | 0/1967 | Farquhar et al. | 229/27 |
| 3,356,258 | 0/1967 | Vesak | 220/115 |
| 3,492,133 | 0/1970 | Milne et al. | 99/194 |
| 3,510,046 | 5/1970 | Reiner | 229/27 |
| 3,511,431 | 5/1970 | Silver | 229/135 |
| 3,554,402 | 0/1971 | Lock | 220/115 |
| 4,157,755 | 6/1979 | Gough | 229/27 |
| 4,293,091 | 0/1981 | Gerard | 229/27 |
| 4,416,412 | 11/1983 | Wischusen, III | 229/27 |
| 4,487,358 | 12/1984 | Ambrose | 229/27 |

FOREIGN PATENT DOCUMENTS

| | | | |
|---|---|---|---|
| 1339828 | 9/1963 | France | 229/27 |
| 40075 | 11/1965 | German Democratic Rep. | 229/27 |
| 1162795 | 8/1969 | United Kingdom | 229/27 |

*Primary Examiner*—William Price
*Assistant Examiner*—Gary E. Elkins
*Attorney, Agent, or Firm*—Walt Thomas Zieliuski; Richard J. Ancel

[57] ABSTRACT

A divided cell container and blank for making it, the container formed from paperboard, particularly corrugated paperboard. The specific improvement of this invention relates to the addition of alignment panels to the divider panel. These added alignment panels insure that when the container blank is folded in forming the container, the divider panel will be aligned with respect to the edges of the remainder of the blank and thus will be properly positioned in the erected container. The container may be closed or may be open at its upper end.

10 Claims, 12 Drawing Figures

FIG. 2
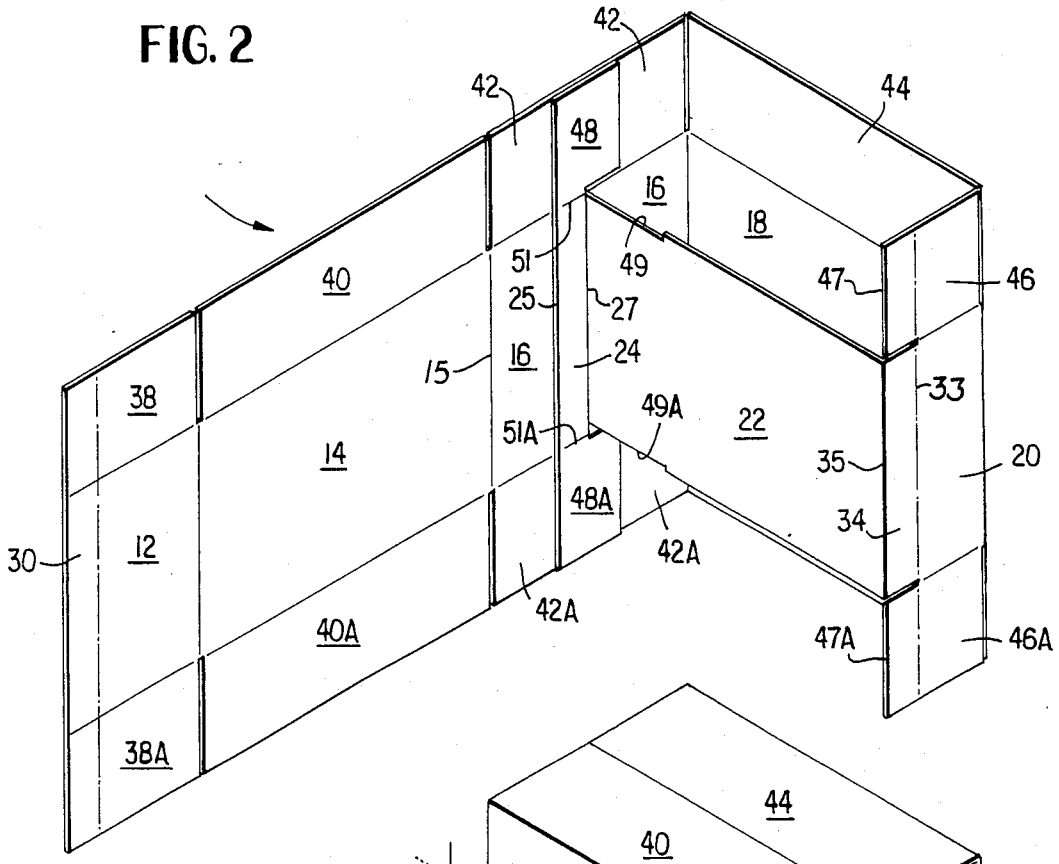
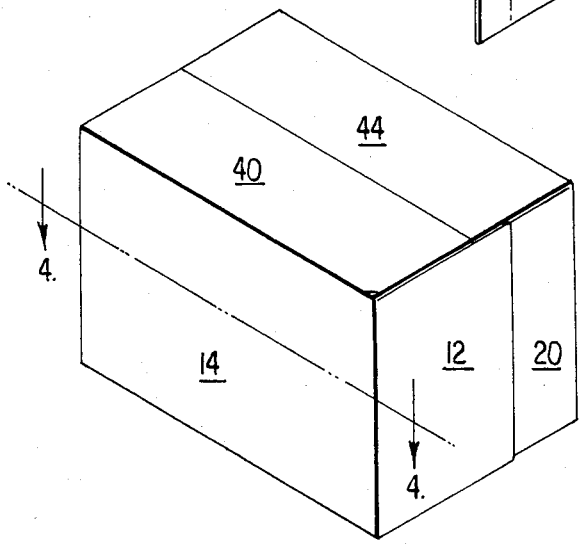
FIG. 3
FIG. 4
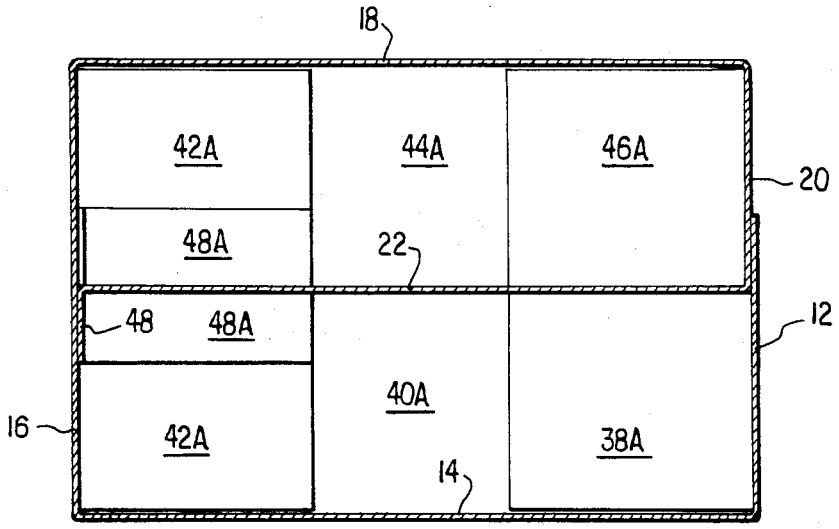

DIVIDED CELL CONTAINER CONSTRUCTION

BACKGROUND OF THE INVENTION

This invention relates to a container formed from corrugated paperboard or other stiff, foldable and usually resilient material. The invention more specifically relates to a one-piece blank for forming a divided cell container.

Divided cell containers, fashioned from a single blank, are known in the container/packaging arts, as may be noted from U.S. Pat. No. 3,326,444 issued June 20, 1967 to Farquhar et al, hereby incorporated by reference. In such a typical prior art construction, a single blank of corrugated paperboard, for example, is defined by a longitudinal series of sidewall panels to which are foldably connected upper and lower, top and bottom closure forming, panels respectively. One end of the longitudinal series of side panels is provided with an extension which defines a divider panel. As typical of prior art constructions, the divider panel is of a width equal to the width of the sidewall forming panels. In the setting up or folding such a prior art blank, to form the squared or set-up container, it has been found that difficulties are often experienced when folding the divider panel back towards the series of sidewall panels, this being one of the steps required to set up or erect the container from the blank. Ideally, this folding back (such as along fold line 34 of the noted Farquhar patent) does not always occur such that the folding is square, i.e., the fold is perfectly aligned with the fold line. Accordingly, when folded all of the way back for the purpose of gluing the free end or free tip of the divider panel to one of the sidewall panels, it has been noted that the divider panel is sometimes tilted or slanted, so that its longitudinal axis is not coincident with the longitudinal axis of the series of sidewall forming panels. In such a circumstance, the free end or tip of the divider panel will extend so as to partially overlap either one or more of the top-forming panels or the bottom-forming panels.

SUMMARY OF THE INVENTION

According to the practice of this invention, a one-piece blank is provided which consists of a series of longitudinally aligned and foldably connected sidewall forming panels, each sidewall forming panel carrying both an upper and a lower panel to form, respectively, top and bottom closures for the completed container, and a foldable divider panel. The free or longitudinally outermost end of the divider panel is provided with alignment panels. The alignment panels extend laterally (transversely) of the longitudinal axis of the blank, the extent of this transverse spanning being such that the total length of the alignment panels and the divider panel, measured in a direction transverse to the longitudinal axis of the blank, is the same as the total width of the sidewall and top and bottom forming panels of the blank. By virtue of this arrangement of elements, when the divider panel is folded over the longitudinal series of sidewall forming panels, for the purpose of securing the free tip or end of the divider panel to a sidewall panel, the divider panel is automatically squared by virtue of edges of the alignment panels being aligned with the top closure and bottom closure forming panels of the blank. Thus, even if the initial folding of the divider panel towards the longitudinal series of sidewall forming panels is not perfectly square, upon reaching its final glue position, the alignment panels of the free end of the divider panel will automatically correct for any improper folding which may initially have been made. Thereafter, the assembly of the blank, by a series of folding and gluing operations, is substantially similar to that of the prior art.

BRIEF DESCRIPTION OF THE DRAWINGS

FIG. 2 is a perspective view illustrating the blank of FIG. 1 at one stage during its setting up to form a completed divided cell container.

FIG. 3 is a perspective view of the completed container formed from the blank of FIG. 1.

FIG. 4 is a plan view cross-section taken along section 4—4 of FIG. 3.

Referring now to FIGS. 1–4 of the drawings, the numeral 10 denotes generally the blank of this invention, the blank being fashioned from corrugated paperboard or other stiff, foldable and resilient material. The numerals 12, 14, 16, 18 and 20 denote sidewall-forming panels arranged in a longitudinally extending series, the panels being folded together by the indicated fold lines. The numeral 11 denotes the longitudinal axis of the series of sidewall-forming panels and is also the longitudinal axis of the blank. The numeral 22 denotes a divider wall forming panel terminating the sidewall forming panels and having an endmost panel portion 24. The numeral 25 denotes the right hand free end of panel 24, while numeral 27 denotes a fold axis. The numerals 30, 32, and 24 denote glue areas to which adhesive is applied to form the completed container.

Figure 1:
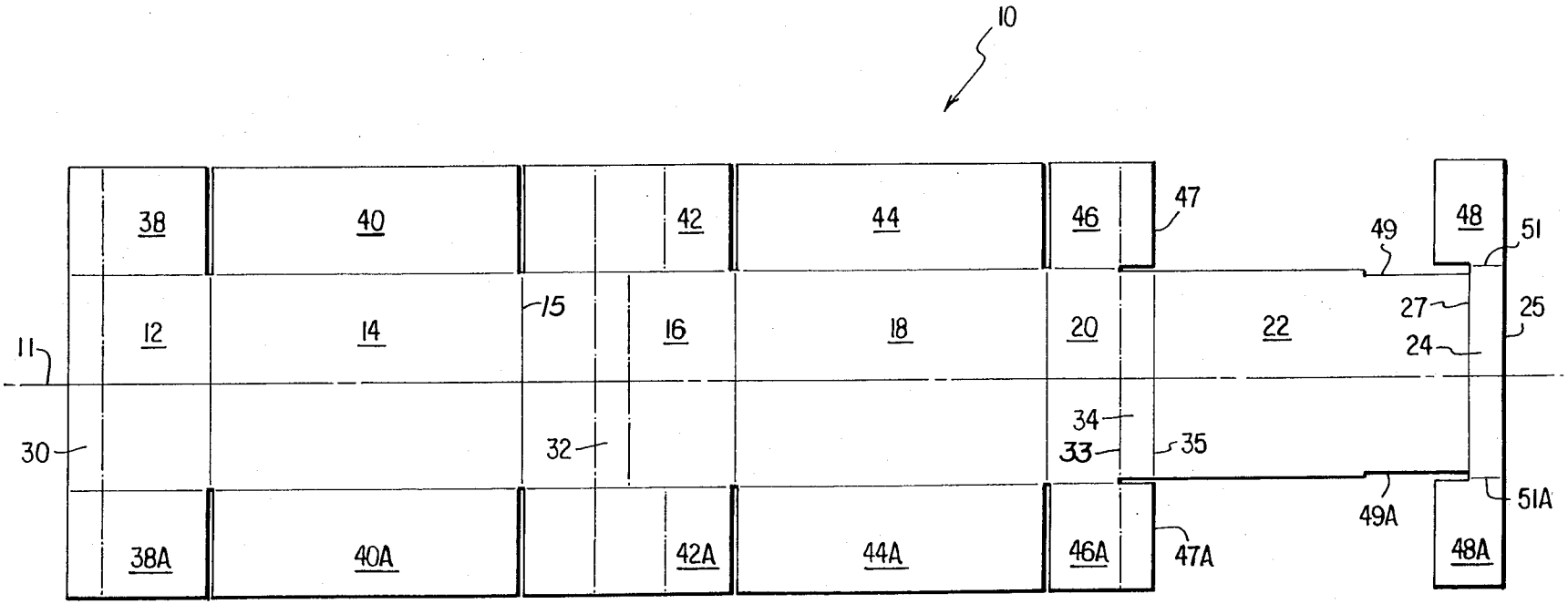
FIG. 1 is a perspective view of the one-piece blank of this invention.
Figure 5:
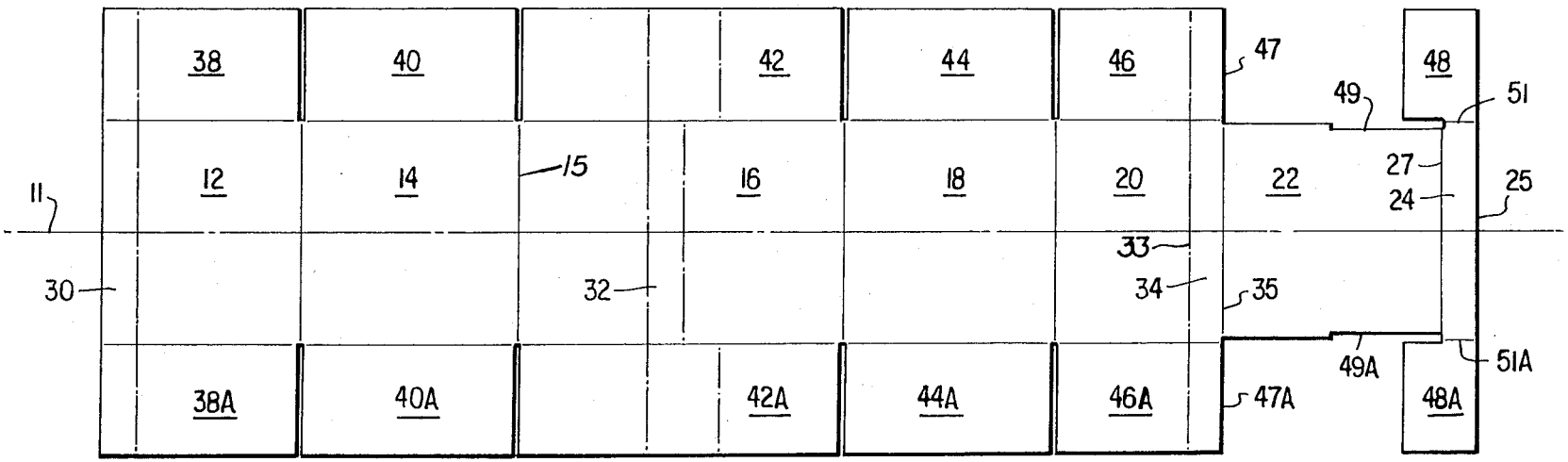
FIGS. 5–8 are views corresponding to FIGS. 1–4, respectively, and illustrate a second embodiment of the invention.
Figure 6:
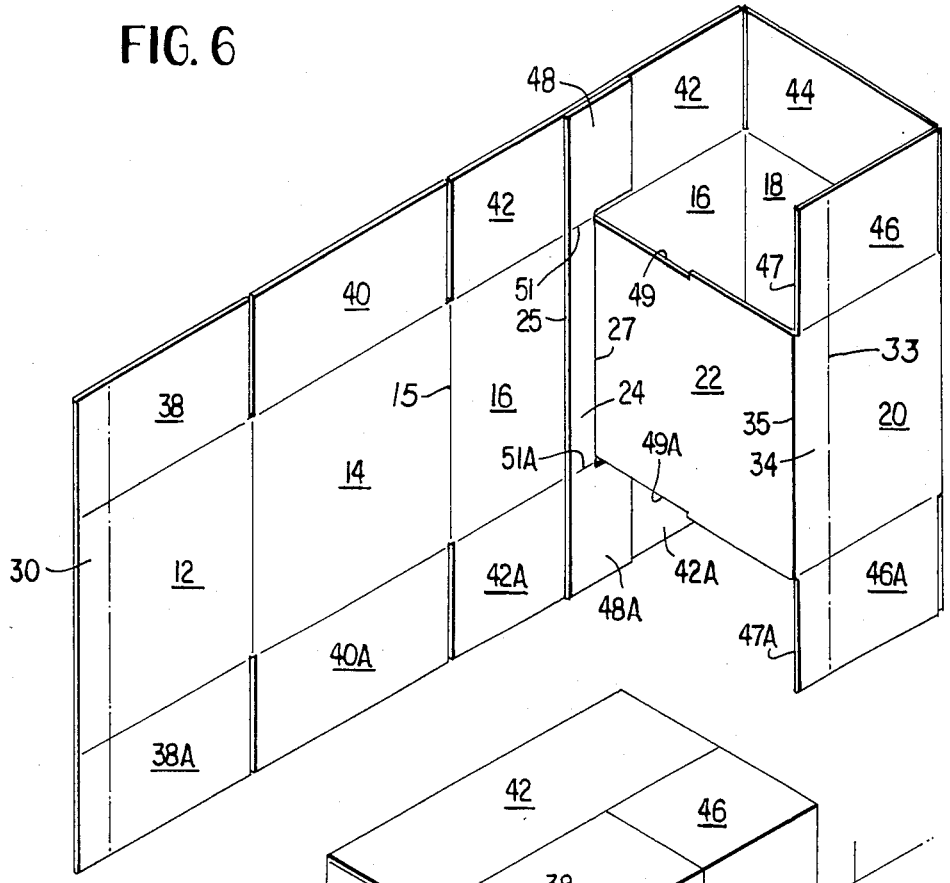
Figure 7:
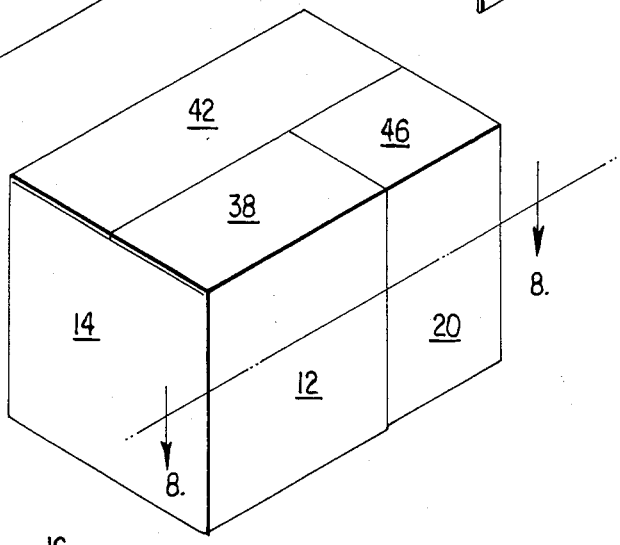
Figure 8:
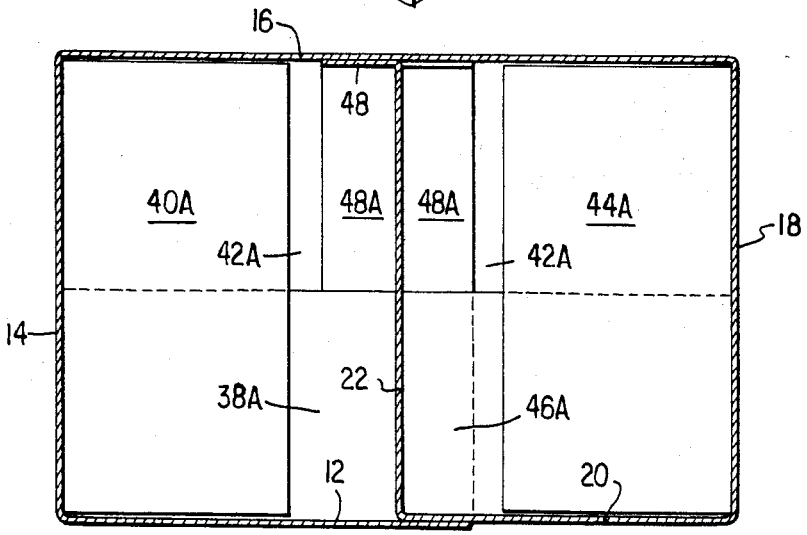

The numerals 38, 40, 42, 44 and 46 denote top closure forming panels which are foldably secured to the upper portions of their respective sidewall forming panels. The same numerals are employed for corresponding panels along the bottom of the blank, these bottom panels forming bottom-forming closures for the completed container and are denoted by the suffix A. The numeral 48 denotes one of two alignment panels, the other being denoted by the numeral 48A. These alignment panels are foldably secured to the right hand end of divider panel 22 and panel portion 24 by the indicated fold lines 51 and 51A. The numerals 49 and 49A denote recesses or cut outs along the right hand, upper and lower edges of divider panel 22. The recesses are of a depth at least equal to the thickness of the aligning panels 48, and 48A and are of a longitudinal extent at least equal to the transverse extent of the aligning panels, i.e., the distance from fold axes 51 and 51A to the outer edges of the respective alignment panels 48 and 48A. The reader will observe that the blank of FIG. 1 possesses mirror symmetry about longitudinal axis 11.

Referring particularly now to FIG. 2 of the drawings, the blank is folded to form a completed container by initially folding divider panels 20, 22 and 24 180° about fold axis 33 with panel portion 24 and alignment panels 48 and 48A being now superposed on glue zone 32 of panel 16, 42 and 42A, respectively. Panels 12 and 14 are now rotated 180° about fold axis 15 so that glue zone 30 is superposed on glue zone 34. A squaring device (old in this art) bears against the top and bottom edges of this folded and flattened structure, to thereby align the alignment panel edges with the edges of the blank. The structure is then compressed to glue together the zones 30 and 34, and zones 32 with 24, 48 and 48A. Only zones 30, 24, 48 and 48A have previously been coated with glue. The sidewalls now form a tube, which is then erected and the tube closed at its ends by the upper and lower series of panels 38–46. Zones 30 and 34 are overlapped to form a seam. FIG. 2 is drawn somewhat differently from this described manner of assembly, for purposes of greater clarity in understanding the invention. Recesses 49 and 49A receive the alignment panels 48 and 48A, respectively. The length of sidewall panel 20 is such that the free edges 47 and 47A of respective panels 46 and 46A fold slightly towards the right (as viewed at FIG. 2) of divider panel 22 when folded towards the container interior. Thereafter, longitudinal top closure panels 40 and 44 are folded down, and thir counterparts for the bottom closure, being panels 44A and 40A are folded upwardly, to thereby complete the container, as indicated at FIG. 3.

FIG. 4 indicates the relationship of the elements previously described in the completed container.

Again referring to FIG. 2 of the drawings, the reader will now really visualize that if the initial folding of divider panel 22 about fold line 33 had not been square (so that the longitudinal axis of panel 22 would not have perfectly coincided with the longitudinal axes of sidewall panels 16, 18, and 20) the matching of the transverse extent of aligning panels 48, 48A and portion 24 of divider panel 22 all with the corresponding transverse extent of panels 42, 42A and 16, will automatically correct for any misalignment. Matching or aligning of the outermost edges of aligning panels 48 and 48A with the outermost edges of panels 42 and 42A, respectively, insures this. The reader can further readily visualize that without the presence of alignment panels 48 and 48A (as is the case with the prior art) the gluing of panel portion 24 to sidewall panel 16 might result in the edges of portion 24 extending either above or below the edges of sidewall forming panel 16.

The reader will further recognize that the presence of recesses 49 and 49A, which receive the alignment panels 48 and 48A, insures that there will be no bulge along the top or bottom of the container, and that all of the top and bottom forming panels will lie flat.

Referrring now to FIGS. 5–8, a second blank and completed container is illustrated. In this second embodiment, the construction is essentially the same, except that the proportions of the blank 10 are varied, so as to define a divided cell container wherein the divider panel 22 extends transversely across the rectangular container, instead of extending longitudinally of the container, as is the case with the embodiment of FIGS. 1–4. The same reference numerals have been employed for the convenience of the reader. The sequence of folding and aligning steps is essentially the same, except that the panels 44 and 44A, for example, are now shorter than panels 42 and 46, 38 and these shorter panels are infolded first in assembling the final container from the position illustrated at FIG. 6.

Figure 9:
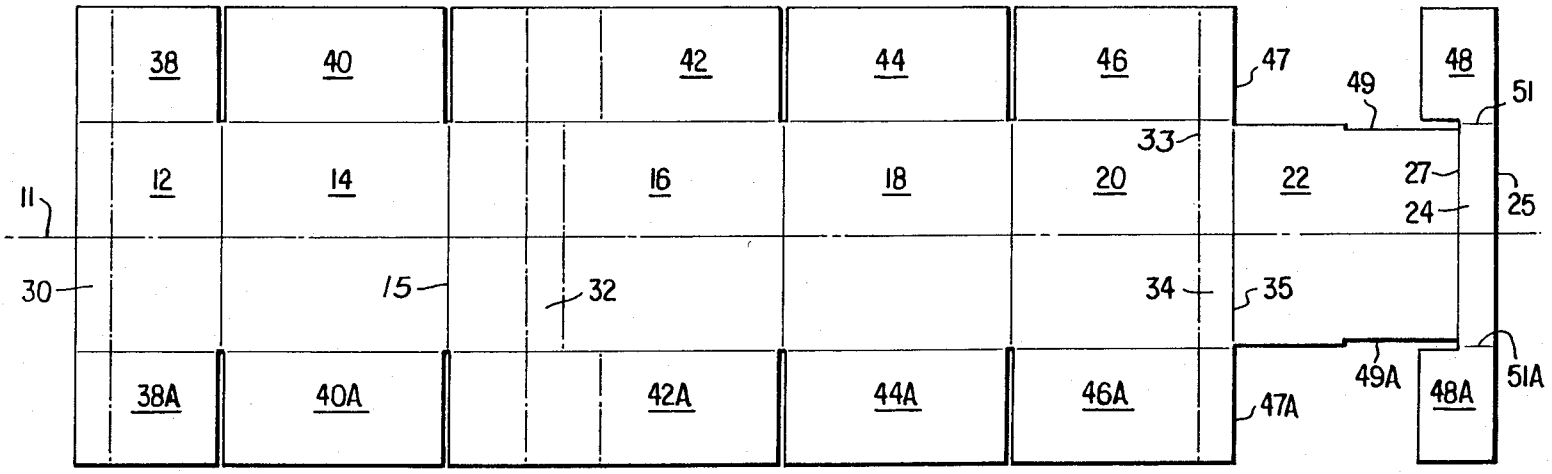
FIGS. 9 and 10 are views corresponding to FIGS. 1 and 2 and illustrate a third embodiment of the invention.
Figure 10:
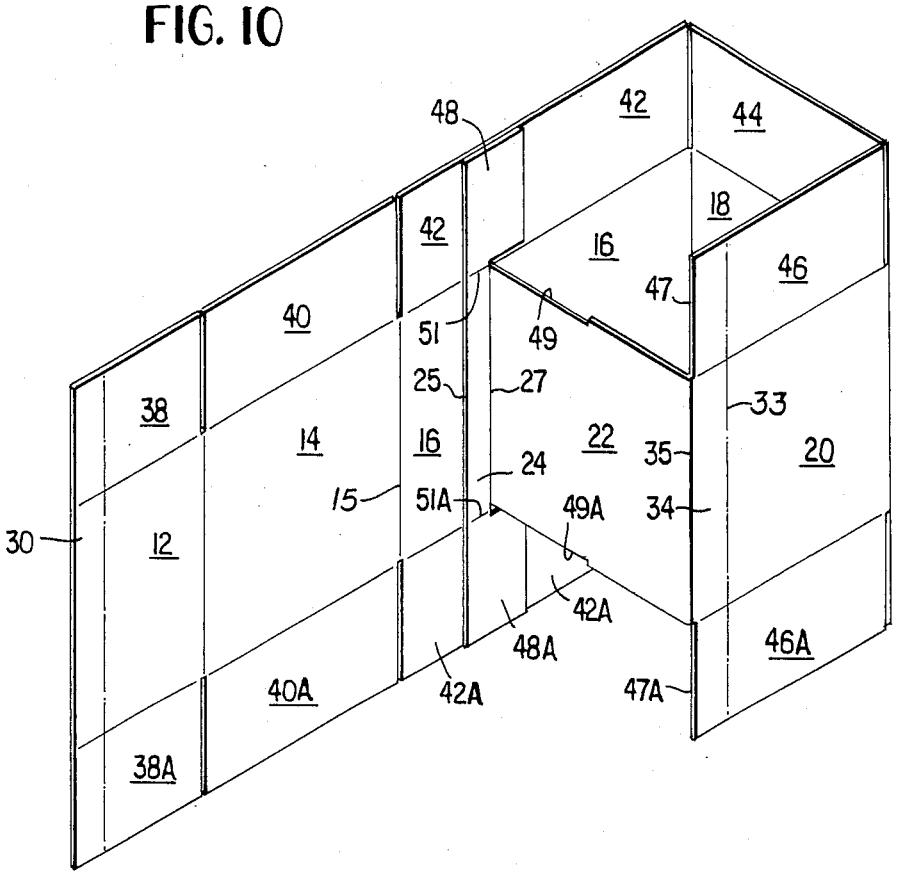
Figure 11:
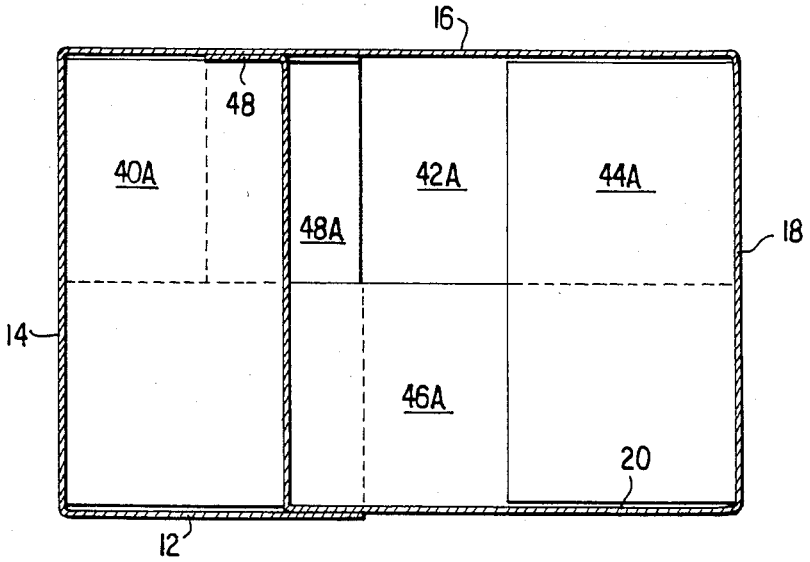
FIG. 11 is a view similar to FIG. 4 illustrating the embodiment of FIGS. 9 and 10.

Referring now to FIGS. 9–11, a third embodiment is illustrated, this embodiment being similar to the embodiment of FIGS. 5–8, except that in this latter embodiment the divider panel 22 is now positioned approximately one-third along the length of the completed container, as may be seen by reference to FIG. 10 and especially to FIG. 11. Again, with respect to the embodiment of FIGS. 9–11, the shorter top and bottom forming panels 44, 44A and 40, 40A are infolded first, with the longitudinal panels 42, 42A and 46, 38 and 46A, 38A being folded over last.

Figure 12:
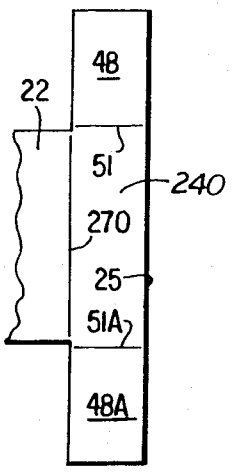
FIG. 12 is a partial plan view illustrating a modification which may be employed in any of the three previously illustrated embodiments of the invention.

Referring now to FIG. 12, a modification of the invention is illustrated, this modification differing from those previously described only in the construction of the right hand end of the divider panel. In FIG. 12, the alignment panels 48 and 48A are essentially the same, with the panel portion corresponding to panel portion 24 of the previously described embodiments now denoted by the numeral 240. Similarly, fold line or axis 27 which defined divider panel portion 24 is now denoted by the numeral 270. The reader may visualize the modification of FIG. 12 as being derived from any of the other embodiments by cutting off the left hand portion of the alignment panels, to the left of fold line 27, and adding them to the right hand portion of the alignment panels. Further, there are no cut away portions such as 49 and 49A for the embodiment of FIG. 12. Otherwise, the reader will readily visualize, as by reference to FIGS. 2, 6 and 10, that the construction is essentially the same. The difference being that the alignment panels will extend completely to the left of fold axis 27. Further, the total length of the blank 10 will be longer using the modification of FIG. 12, hence more material is required and it is accordingly somewhat more expensive. However, the same edge alignment (and hence divider panel alignment) function is performed.

While the description has treated of a tubular type container closed at both ends and blank for forming it, there are situations where only the bottom of the container is required. In such situations the top closure forming panels 38, 40, 42, 44, 46 and top aligning panel 48 are omitted from the blank and the completed container is open-ended at the top. Otherwise, the construction is the same as that given above, it being necessary to align the bottom edge of the lower alignment panel 48A with the bottom edge of bottom forming panel 42A. The terms longitudinal, transverse, right, left, upper, lower, top and bottom, have been employed as an aid to describe the blank and container of this invention and are not used in a limiting sense.

Generally speaking, the invention relates to a one-piece blank for forming a divided cell container, the blank being, typically, fashioned from corrugated cardboard. The divider panel is provided at its free end with laterally extending alignment panels so as to increase the width of the divider panel end, making it equal to the width of remainder of the blank. This insures that, upon folding the divider panel free end back upon and affixing it to the blank, the divider panel will be properly aligned.

What is claimed is:

1. A divided cell container formed from a unitary blank of stiff, foldable sheet material, such as paperboard, the container having foldably and serially connected sidewall panels, the sidewall panels forming a tube having an overlapped seam, the same being defined by the overlapping of one end of one endmost sidewall panel relative to one end of another endmost sidewall panel, tube end closure panels each foldably connected to a respective sidewall panel and forming an end closure for an end of the tube, a divider panel foldably connected at one end to an end of one of the sidewall forming panels forming the seam, the divider panel having an other end secured to one of said sidewall panels by a folded, endmost panel portion, the folded, endmost panel portion being in surface contact with said one sidewall panel and also being at right angles to the divider panel, the folded, endmost panel portion carrying at least one alignment panel, said alignment panel having an outermost edge, said alignment panel being a folded extension of said endmost panel portion of the divider panel, said alignment panel secured in surface contact to one of the tube end closure panels, said one tube end closure panel having an outermost edge, the outermost edge of the alignment panel being aligned with the outermost edge of the end closure panel to which it is secured, the alignment panel being in a plane at right angles to the plane of the divider panel and at right angles to the folded, endmost panel portion.

2. The container of claim 1 wherein one edge of the divider panel is at least partially recesses to a depth at least equal to the thickness of the alignment panel, the recessed portion receiving the alignment panel.

3. The container of claim 1 wherein the alignment panel is located completely to one side of the divider panel.

4. The container of claim 1 wherein one portion of the alignment panel extends to one side of the divider panel and another portion of the alignment panel extends to the other side of the divider panel.

5. The container of claim 4 wherein said alignment panel is received by a recess in an edge of the divider panel, the recess being of a depth at least equal to the thickness of the alignment panel.

6. A one-piece blank for forming a divided cell container, the blank formed from stiff, foldable sheet material, such as paperboard, the blank including a longitudinal, aligned, horizontally disposed series of foldably connected sidewall forming panels and having an imaginary longitudinal axis, each sidewall forming panel having a bottom and having at least a respective bottom closure forming panel each foldably connected to the bottom of a respective sidewall forming panel, a longitudinally extending divider panel foldably secured to one vertically extending edge of an endmost sidewall forming panel of the longitudinal series of sidewall forming panels, that bottom closure forming panel nearest the divider panel having a portion extending horizontally beyond that end of the divider panel foldably secured to said one vertically extending edge, said divider panel having an endmost panel portion opposite to its end portion which is secured to said endmost sidewall forming panel of the series of sidewall forming panels, the endmost divider panel portion being foldable about a transverse axis and foldably carrying at least a lower aligning panel foldable about an axis parallel to said longitudinal axis, the panels being generally rectangular, said lower aligning panel and said divider panel having a total width, measured in a direction transverse to said longitudinal axis, equal to the total width of that sidewall forming panel and its corresponding bottom closure panel to which said divider panel and its lower aligning panel are connected.

7. The blank of claim 6 wherein one portion of said lower alignment panel extends beyond said transverse fold axis in a direction toward the sidewall forming panels and another portion extends in an opposite direction.

8. The blank of claim 7 wherein the extent of the lower alignment panel, measured in a direction parallel to the longitudinal axis of the blank, is greater than the same directional extend of the endmost panel portion.

9. The blank of claim 6 wherein all portions of said lower alignment panel extend beyond said transverse fold axis in a direction away from the sidewall panels.

10. The one-piece blank of claim 6 wherein at least the lower edge of the divider panel carries a recessed portion adjacent the free end of the divider panel, the recess being of a depth at least equal to the thickness of the lower alignment panel, the recess extending from said transverse fold axis towards the sidewall forming panels a distance at least equal to the transverse extent of the lower aligning panel.

* * * * *